US005513082A

United States Patent [19]

Asano

[11] Patent Number: 5,513,082

[45] Date of Patent: Apr. 30, 1996

[54] SMALL LAMP SOCKET DEVICE FOR PANEL/PRINTED BOARD

[75] Inventor: Yoichi Asano, Akita, Japan

[73] Assignee: Oshino Electric Lamp Works, Ltd., Tokyo, Japan

[21] Appl. No.: 508,567

[22] Filed: Jul. 27, 1995

[30] Foreign Application Priority Data

Dec. 16, 1994 [JP] Japan ..... 6-313487

[51] Int. Cl.[6] ..... H01R 33/00

[52] U.S. Cl. ..... 362/226; 362/800; 248/222.12

[58] Field of Search ..... 362/226, 365, 362/366, 368, 396, 800; 248/222.12

[56] References Cited

U.S. PATENT DOCUMENTS 4,471,414 9/1984 Savage, Jr. ..... 362/226
4,959,761 9/1990 Critelli et al. ..... 362/226
5,264,998 11/1993 Bax ..... 362/226
5,440,468 8/1995 Savage, Jr. ..... 362/226

*Primary Examiner*—Denise L. Gromada
*Assistant Examiner*—Alfred Basichas
*Attorney, Agent, or Firm*—Keck, Mahin & Cate

[57] ABSTRACT

This invention provides a small lamp socket device for a panel/printed board which can be fitted from the surface of a printed board with a one-touch operation. Contact portions for a pattern face and snap portions for clamping and contacting a panel/printed board are disposed at upper and lower positions of the walls of an insulating socket main body 1, to which a small lamp is fitted, so that they protrude and oppose one another with a predetermined space between them. The snap portions have resilience so that they can come into and out from the socket main body, and the panel/printed board is clamped by the contact portions 6 and the snap portions after passing through a fitting hole of the panel/printed board.

6 Claims, 5 Drawing Sheets

SMALL LAMP SOCKET DEVICE FOR PANEL/PRINTED BOARD

BACKGROUND OF THE INVENTION

This invention relates to a small lamp socket device for a printed board or panel in which the small lamp socket device is fitted to a panel, a printed board, etc., used for indicating and illuminating many kinds of meters of automobiles, audio-visual appliances, and so forth.

A small lamp socket used for indicating and illuminating meters fitted to a panel or a printed board that has been used generally has the construction shown in FIG. 23, for example. A cylindrical socket main body a is fitted into a socket fitting hole d bored in a panel or a printed board b and having guide/positioning grooves c on both sides, contact portions (power feed contact members) coming into electric contact with a pattern face (printed wiring side) e of a board are formed in such a manner as to protrude from both sides of the socket main body a, and a flange-like reception seat portion g for clamping the board is formed at the lower part of the socket main body. Therefore, this small lamp socket is fitted to the printed board in the following way. First, the socket main body a is positioned from the back side (see an arrow in FIG. 23) of the printed board b so that the contact portions (or support plates) f on both sides oppose the guide/positioning grooves c formed on both sides of the socket fitting hole d, and after the contact portions f pass through the guide/positioning grooves c, the socket main body a is turned 90° C. so as to bring the contact portions f into sliding contact on the pattern face e. In this way, the printed board b can be clamped between the contact portions f and the flange-like reception seat portions g below the former.

In other words, the fitting operation of the socket main body a to the printed board (or the panel) according to the prior art requires two operations, i.e. the inserting operation to the printed board (straight drive) and 90° C. rotation (twist), and is troublesome. Accordingly, one-touch operation suitable for automatic assembly cannot be accomplished. Moreover, because the socket device must be handled from the back side of the printed board, its fitting direction is different from that of various other components which are provided at the front surface positions where the printed wiring is disposed, such as IC, and from this aspect, the fitting operation cannot cope with automatic assembly.

SUMMARY OF THE INVENTION

An object of the present invention is to provide an improved small lamp socket device for a panel/printed board.

Another object of the present invention is to provide a small lamp socket device for a panel/printed board which has flexible contact portions and flexible snap portions on both side walls of a socket main body so as to oppose one another, which makes it possible to fit the socket main body from the front surface side by causing the snap portions to freely pass through a socket fitting hole, and which can thus solve the problems with the prior art described above.

According to the present invention, there is provided a small lamp socket device for a panel/printed board wherein contact portions for a pattern face and snap portions for clamping and contacting the panel/printed board, each being made of a metallic spring material and serving as a terminal, are disposed at upper and lower positions of both side walls serving as support arms disposed on both sides of an insulating socket main body to which a small lamp is fitted, in such a fashion as to protrude and oppose one another with a predetermined space between them, the snap portions are provided with resilience so that they can come into and out from the socket main body, and the panel/printed board is clamped by the contact portions and the snap portions after passage through a fitting hole of the panel/printed board.

According to the present invention, there is further provided a small lamp socket device for a panel/printed board wherein contact portions for a pattern face and snap portions for clamping and contacting the panel/printed board, each being made of a metallic spring material and serving as a terminal, are disposed at upper and lower positions of both side wall as serving as support arms disposed on both sides of an insulating socket main body to which a small lamp is fitted, in such a fashion as to protrude and oppose one another with a predetermined space between them, the snap portions are provided with resilience so that they can come into and out from the socket main body, the panel/printed board is clamped by the contact portions and the snap portions after passage through a fitting hole of the panel/printed board, and fall-prevention protuberance portions are formed at front and rear walls orthogonally crossing the terminal positions of the socket main body.

The terminals of the contact portions and the snap portions may have a unitary structure. Alternatively, the terminals of the contact portions and the snap portions may have separate structures.

The snap portions may preferably be formed by bending arcuate engagement plate each having a plurality of engagement step portions for a fitting hole edge at the upper end thereof on both sides in a hook-like shape.

As described above, the contact portions for a pattern face, made of a metal spring material and serving as a terminal, and the snap portions for clamping and contacting the panel/printed board are formed at upper and lower positions of both side walls of the socket main body to which the small lamp is fitted, in such a manner as to protrude and oppose one another with a suitable angle and a suitable space between them, and the snap portions can freely pass through the fitting hole of the panel/printed board. Therefore, when the socket main body is fitted to the fitting hole of the panel/printed board, the socket main body is inserted from below and from the front surface of the panel/printed board. Then, snap inclined portions of the snap portions which are formed on both sides of the socket main body and open upward are restricted by the fitting hole edge and are closed in such a manner as to enter terminal reception grooves. After they pass through the fitting hole, the snap portions return to the original state and open due to its resilience. At this time, the contact portions opposing the snap portions come into contact with the pattern face (the printed wiring side) disposed round the fitting hole of the front surface of the panel/printed board, while the socket main body itself is clamped and fixed by the snap portions and the contact portions. In other words, the socket main body can be fitted to the panel/printed board by only the unidirectional push operation (one-touch or a single push-in operation). At this time, further, the engagement step portions of the engagement plates of the snap portions catch and engage with an edge of the fitting.

In this case, if the socket main body is equipped with the fall-prevention protuberance portions, the socket main body can be fitted by merely positioning the protuberance portions to the guide/positioning grooves on both sides of the fitting hole of the panel/printed board when front surface fitting is made. Even when the contact portions and the snap portions are brought into conformity with the guide/positioning grooves at the time of removal of the socket main body from the back side of the panel/printed board, the protuberance portions inevitably come into contact with the fitting hole edge and do not fall into the front surface side.

DESCRIPTION OF PREFERRED EMBODIMENTS

Figure 1:
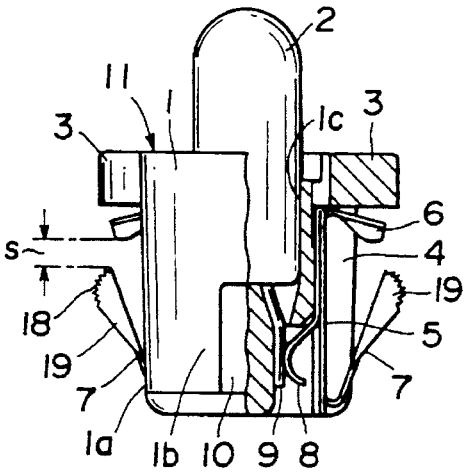
FIG. 1 is a partially cut-away front view of a small lamp socket device according to an embodiment of the present invention.
Figure 4:
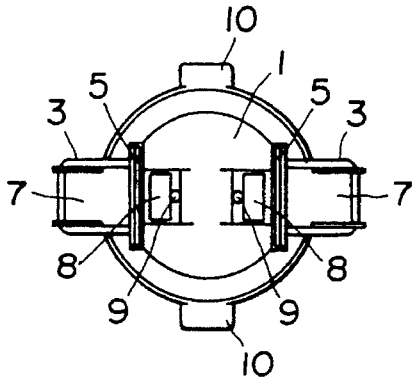
FIG. 4 is a bottom view of the small lamp socket device shown in FIG. 1.
Figure 2:
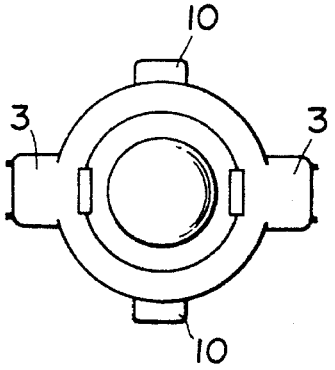
FIG. 2 is a plan view of the small lamp socket device shown in FIG. 1.
Figure 5:
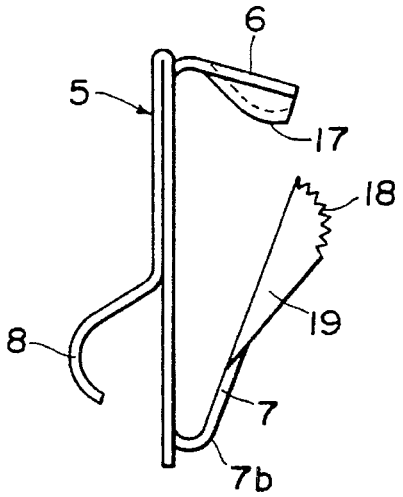
FIG. 5 is a side view of a terminal portion of the small lamp socket device shown in FIG. 1.
Figure 3:
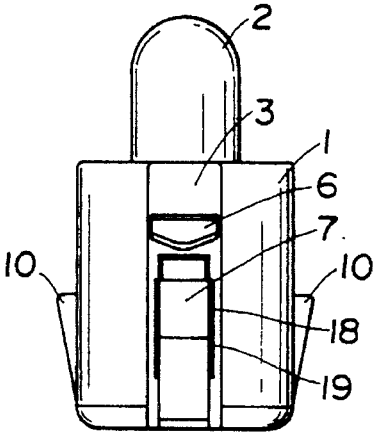
FIG. 3 is a side view of the small lamp socket device shown in FIG. 1.
Figure 6:
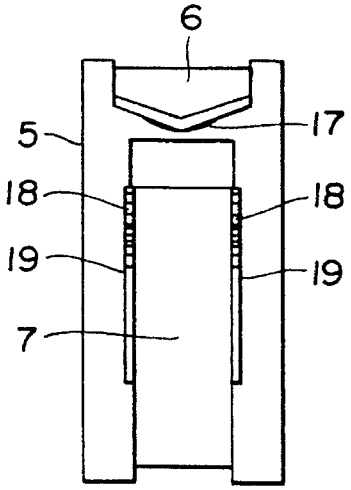
FIG. 6 is a front view of the terminal portion.
Figure 7:
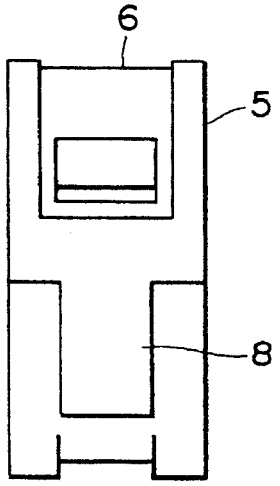
FIG. 7 is a rear view of the terminal portion.

Hereinafter, a preferred embodiment of the present invention will be described with reference to the accompanying drawings.

FIGS. 1 to 8 show a small lamp socket device equipped with a fall-prevention protuberance 10 according to an embodiment of the present invention. Reference numeral 1 denotes a cylindrical insulating socket main body, and a small lamp 2 is fitted to an upper end of the socket main body 1. A terminal 5 formed by suitably bending and shaping one metal spring plate is fitted to each terminal reception groove 4 formed in a longitudinal direction of each side wall 1*a* at a lower portion of each support arm 3 which is disposed on each side of the socket main body 1.

The terminal 5 has the following structure. A contact portion 6 for a pattern face which serves as a power feed/electrical contact and a snap portion 7 for clamping a panel/printed board are disposed at vertical (longitudinal) positions in such a manner as to keep a predetermined space s (FIG. 1) corresponding to the sheet thickness of a panel/printed board (shown at 12 in FIG. 11) at a suitable angle (in an inverted V-shape) so as to protrude in a confronting relation so that they oppose each other. An arcuate terminal portion 8 is formed on the opposite side (inside) relative to both the contact portion 6 and snap portion 7 so that the arcuate terminal portion faces a lead wire 9 of the small lamp 2 fitted to the lamp fitting portion 1*c* of the socket main body 1 (see FIGS. 5 and 8). A wedge-shaped fall-prevention protuberance portion 10 is disposed below front and rear walls 1*b* orthogonally crossing the terminal reception groove 4 of the socket main body 1, and all these elements together constitute the small lamp socket device 11 for the panel/printed board. This small lamp socket device 11 fits into a round socket fitting hole 12 (FIG. 11) disposed in the panel/printed board 12 having a predetermined sheet thickness. Guide/positioning grooves 14 are formed by cutting both sides of this fitting hole 13, and a copper foil pattern surface 16 is disposed in an arc form on the surface portion 12*a* to form front and rear edges of the fitting holes 13 interposing the guide/positioning grooves 14, 14 so that the copper foil pattern surface 16 is connected with a printed wiring 15.

With respect to the shape of the contact portion 6, a center portion of the distal end is curved so as to form a contact portion 17 and to provide flexibility by one sheet. Further, the snap portion 7 has a structure wherein arcuate engagement plates 19 each having a saw-shaped engagement portion 18 for a fitting hole edge at the upper end are disposed on both sides in a hook shape (see FIGS. 5 and 8).

The socket main body has a unitary structure wherein the lamp fitting portion 1*c* is formed by an insulating material such as a plastic at the center, the terminal reception grooves 4 are formed on both side walls, the fall-prevention protuberance portions 10 are formed at the orthogonal positions of the side walls with respect to the former, and the support arms 3 protrude at upper portions on both sides.

When one sheet material is used to form the terminal 5, a metal spring sheet having a predetermined width and length is suitably punched out so that the terminal portion 8 and the contact portion 6 can be formed by bending the sheet to opposite sides, and the snap portion 7 can be formed by bending at the lower portion. Accordingly, the terminal 5 can be produced easily by bending.

Figure 9:
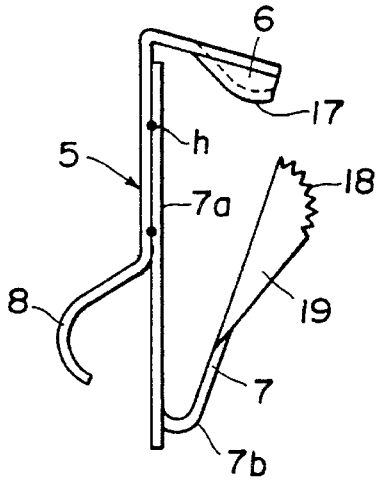
FIG. 9 is a side view of a terminal portion in another embodiment of the invention, wherein contact portions and snap portion as terminals are formed separately.
Figure 8:
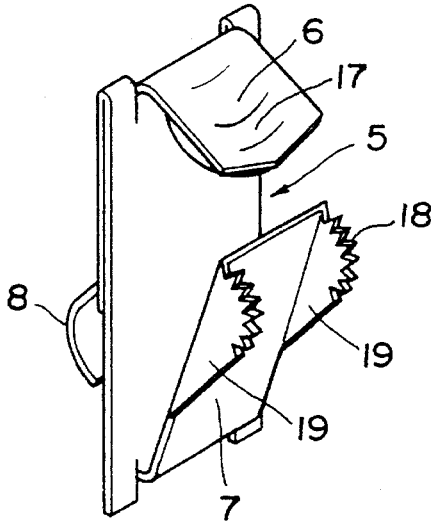
FIG. 8 is a perspective view of the terminal portion.

In another embodiment shown in FIG. 9, the terminal 5 may have a structure by using two metal spring materials in combination wherein one metal spring material is used for forming both the terminal portion 8 and the contact portion 6 and another metal spring material is used for forming the snap portion 7, and the connection portion 7*a* which is one end of the snap portion 7 is integrated with a part of the terminal portion 8 by lap welding "h", etc., so as to obtain a unitary structure.

Figure 10:
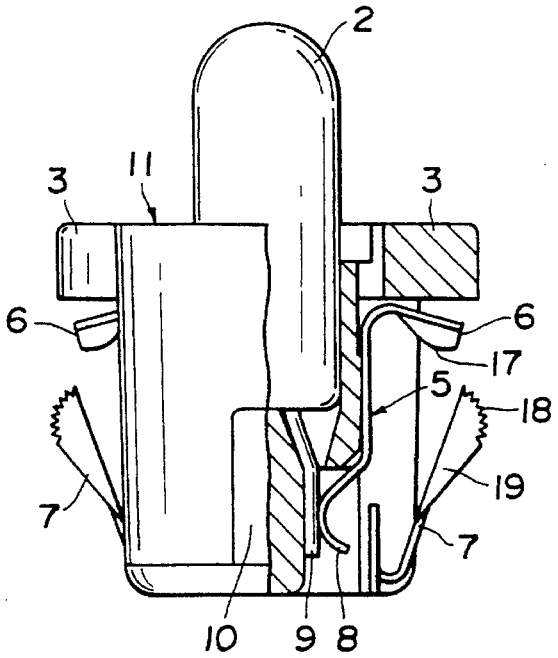
FIG. 10 is a side view showing the principal portions of the small lamp device according to another embodiment wherein the contact portions and the snap portions are formed separately and assembled separately.

As in still another embodiment shown in FIG. 10, the terminal 5 may have a structure wherein the terminal portion 8 and the contact portion 6 are formed integrally with each other in the same way as described above but the snap portion 7 is an independent and separate component. This structure of the terminal 5 is suitable for insulating both (upper and bottom) surfaces of the panel/printed substrate 12. In other words, the snap portion 7 can be insulated from the electrically conductive terminal portion for feeding power.

Figure 11:
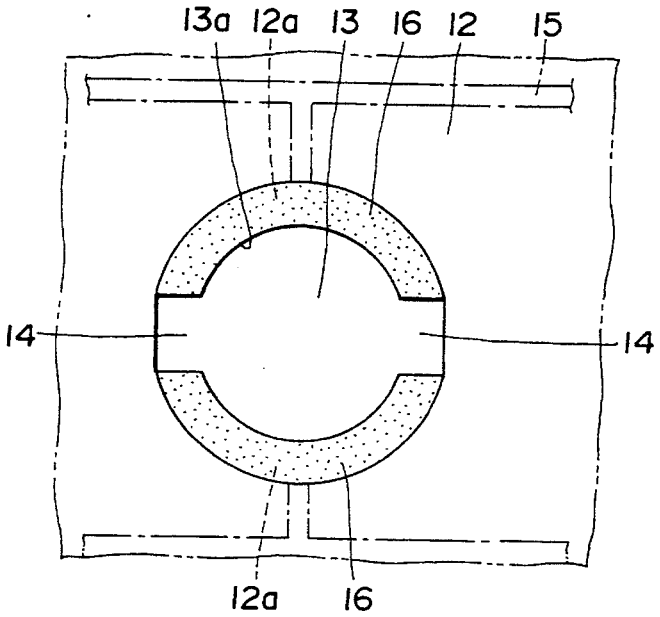
FIG. 11 is a front view of a fitting hole of the printed board.
Figure 12:
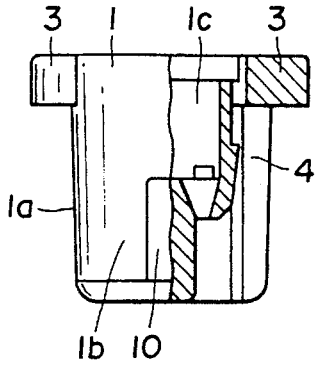
FIG. 12 is a partially cut-away side view of the socket main body.
Figure 13:
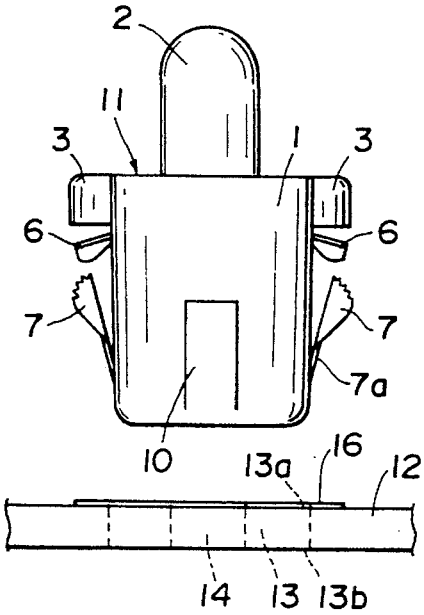
FIG. 13 is an explanatory side view of the socket main body and the printed board for explaining positioning of the socket main body to the fitting hole of the printed board.

With reference to FIG. 11, when the small lamp socket device 11 is fitted into the socket fitting hole 13 formed in the predetermined printed board 12, the socket main body 1 (FIG. 12) to which the small lamp 2 is fitted in advance is clamped by a hand portion (not shown) of a suitable automatic assembly apparatus. In this case, the positions of the fall-prevention protuberance portions 10 on both sides of the socket main body 1 are set at the front face position of the printed substrate 12 in such a manner as to face the guide/positioning grooves 14 on both sides of the fitting hole 13, at which the width of the grooves 14 is somewhat greater than that of the protuberance portion 10, and the socket main body 1 is positioned so that the lower end of the socket main body 1 is opposed to, or in a confronting relation to, the fitting hole 13 (see FIG. 13).

Figure 14:
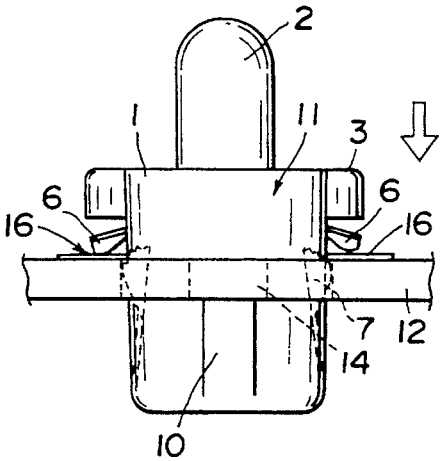
FIG. 14 is an explanatory side view showing the state where the socket main body fits into the fitting hole of the printed board.
Figure 15:
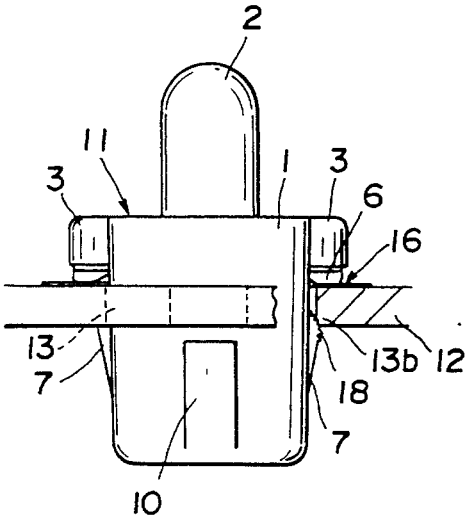
FIG. 15 is an explanatory view showing the state where the snap portions of the socket main body engage with the fitting hole mouth edge of the printed board.
Figure 16:
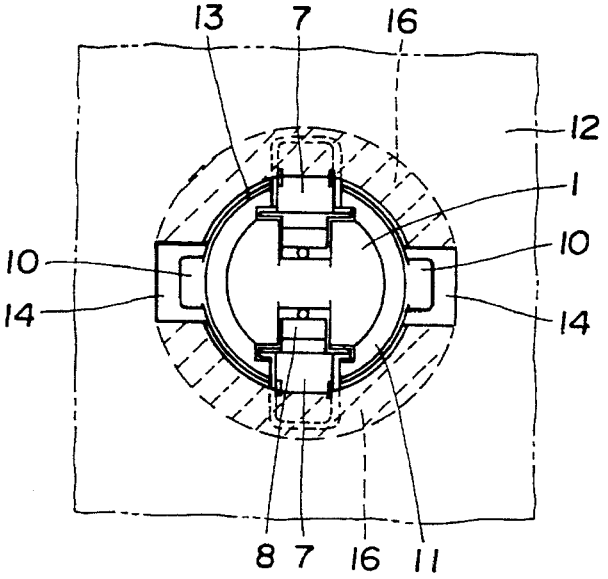
FIG. 16 is an explanatory view of the socket device, seen from the back side of the fitting hole shown in FIG. 15.

Then, the socket main body 1 is moved towards the fitting hole 13 and its distal end is fitted into the fitting hole 13. Then, the fall-prevention protuberance portions 10 on both sides of the lower portion face the lower surface (back side) of the printed board 12 through the mating guide/positioning grooves 14, and the inclined leg portion 7*b* of the snap portion 7 inclined at the orthogonal position is pushed back by the front side edge 13*a* of the fitting hole 13, is thereby restricted in its backward movement, and temporarily enters fully the terminal reception groove 4 (see FIG. 14). At the moment when the step protuberance portion 10 reaches the lower surface of the printed board 12 and the snap portion 7 passes through the fitting hole 13, the spring is released from restriction, and the snap portion 7 returns to the original open portion and protrudes outward due to its resilience. In this case, suitable portions of the fitting hole edge engagement portions of the arcuate engagement plates 19 on both sides of the snap portion 7 engage with the back side edge 13*b* of the fitting hole 13 through pawl engagement, and stop. At this time, the contact portion 6 which is the front surface opposing the snap portion 7 comes into contact with the arcuate pattern face 16 to provide a complete electric connection (see FIG. 15).

In other words, the small lamp socket device 11 can be fitted to the fitting hole 13 of the printed board 12 through a so-called "one-touch operation" by merely inserting the socket main body 1 into the fitting hole 13 from the front surface of the printed board 12 because the printed board 12 is tightly and firmly clamped between the snap portions 7 and the contact portions 6 which are formed on both side walls of the socket main body 1 so that they protrude and oppose one another.

Even when the socket main body 1 rotates inside the fitting hole 13 due to vibration, etc., under the use state where the small lamp fitting device 11 is fitted to the printed board 12, the fall-prevention protuberance portion 10 of the socket main body 1 existing at the position of the guide/position of the guide/positioning groove 14 moves to the lower surface of the printed board 12 and attains the protuberance engagement. Accordingly, fall-off does not occur.

To remove the small lamp socket device 11 such as when the lit small lamp 2 goes out for some reason or other and must be replaced (generally, the replacement work is carried out from the back of the board in the lamp of this kind such as a built-in lamp of a meter of an automobile), the rear part of the socket main body 1 protruding from the fitting hole 13 is nipped and is then turned by 90° C. (see FIGS. 17 and 18). Then, the support arms 3 of the socket main body 1 at the front surface position (the right side) coincide with the guide/positioning grooves 14 of the fitting hole 13. Accordingly, the socket main body 1 can be easily removed by pulling it back under this state. Needless to say, the snap portions 7 and the contact portions 6 facing one another and clamping the printed board 12 between them face the guide/positioning grooves 14 at which the printed board 12 is not positioned at this time, no problem occurs in the removing work.

Figure 18:
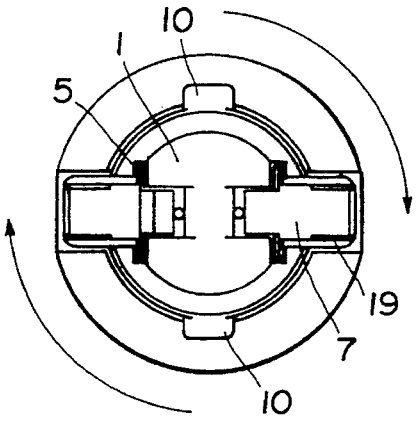
FIG. 18 is an explanatory view of the socket device showing the positional relationship of fall-prevention protuberance portions when support arm portions of the socket main body are in conformity with the guide/positioning grooves of the fitting hole.
Figure 17:
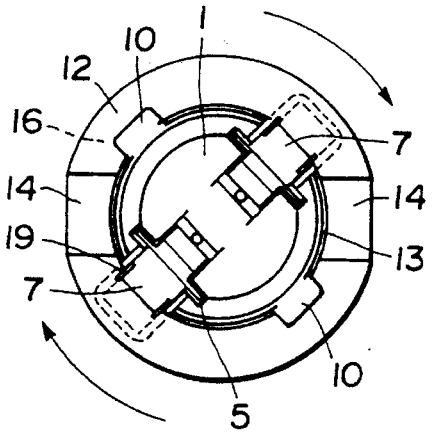
FIG. 17 is an explanatory view of the socket device for removing the socket main body from the fitting hole.
Figure 19:
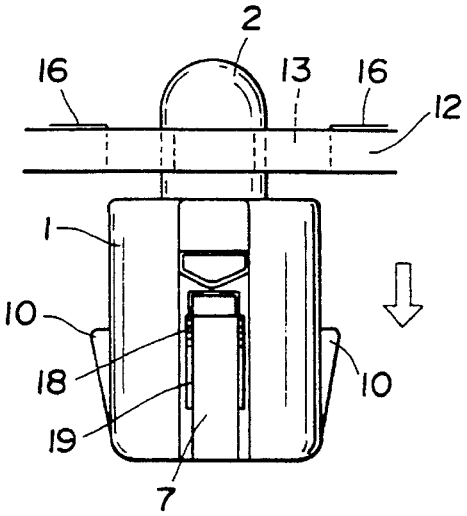
FIG. 19 is an explanatory side view of the socket device showing the state where the socket main body is removed from the fitting hole.

When the small lamp socket device 11 is removed from the back side of the printed board 12, the fall-prevention protuberance portion 10 is hooked up on the back side edge 13*b* when the socket main body 1 is turned (see FIGS. 17 and 18). Accordingly, the socket main body 1 remains in the engagement under this state and does not fall off in the inserting direction (front surface).

Figure 20:
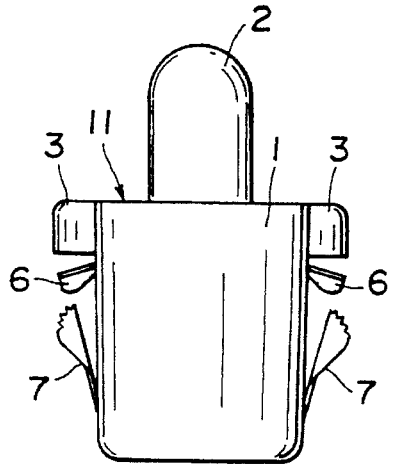
FIG. 20 is a front view of still another embodiment of the socket main body which has no fall-prevention protuberance portions.

FIG. 20 shows the small lamp socket device not equipped with the fall-prevention step protuberance portion according to another embodiment of the invention. In this case, only the snap portions 7 and the contact portions 6 are disposed at right and left positions of the drum portion of the socket main body 1 in such a manner as to protrude from the drum portion and to oppose one another. If fall-off in the inserting direction due to vibration, etc., is not a problem in this embodiment, the fall-prevention protuberance portion 10 need not be disposed. In this case, too, the socket main body 1 can be fundamentally fitted into the fitting hole 13 by inserting it from the front surface of the printed board 12. However, since there is no fall-prevention protuberance portion at the drum portion of the socket main body 1 in this embodiment, accurate positioning of the insertion position need not be secured, and the fitting work can be made easily and simply.

Figure 22:
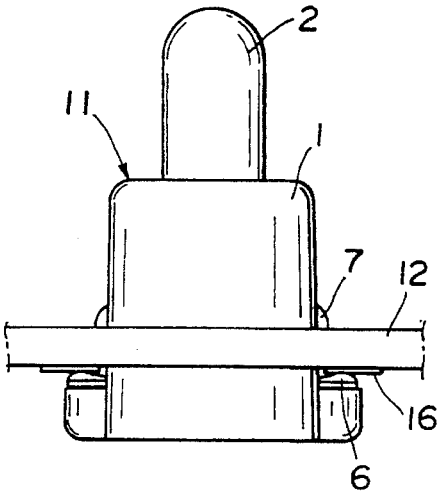
FIG. 22 is an explanatory view of the socket main body shown in FIG. 21, showing that the socket main body is fitted to the fitting hole.
Figure 21:
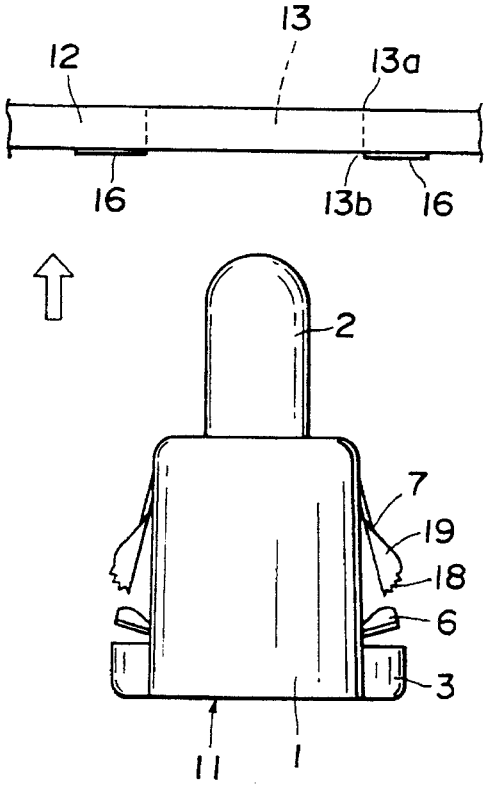
FIG. 21 is an explanatory view of the socket main body of still another embodiment in which a pattern face is disposed on the back of the printed board.
Figure 23:
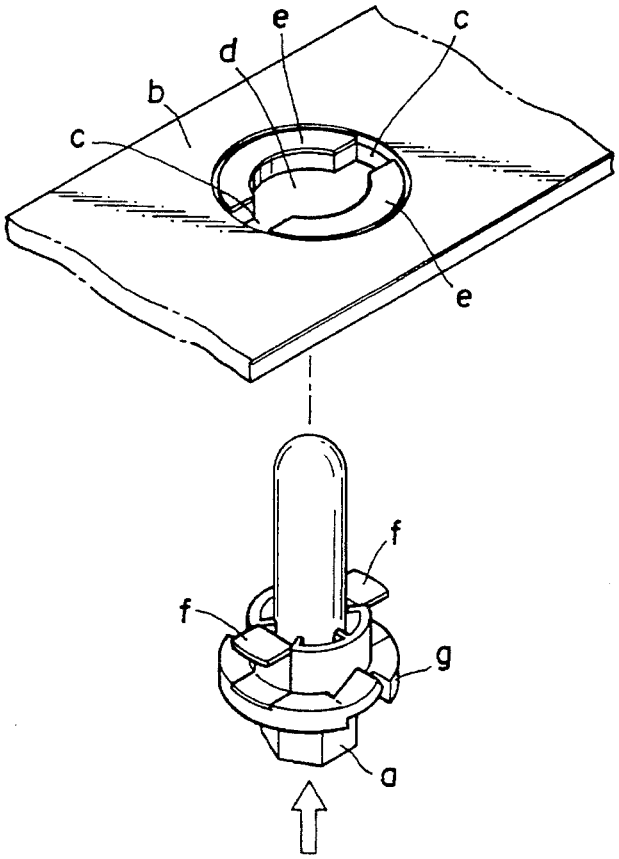
FIG. 23 (PRIOR ART)
FIG. 23 shows a prior art and is an explanatory view showing the relationship between the fitting hole and the socket main body according to the prior art.

FIGS. 21 and 22 shows a small lamp socket device according to still another embodiment, wherein the arrangement of the small lamp is reversed and the lamp is fitted from the back of the printed board. In this case, the support arms 3 are disposed on both sides of the lower end (rear portion) of the socket main body 1, and the snap portions 7 for clamping the panel/printed board are disposed at an upper portion and the contact portions (power feed contact portions) 6 for the pattern face are disposed at a lower portion in a vertically confronting relation. In this type, too, the fall-prevention protuberance portion 10 is not disposed. The pattern face 16 of the printed board 12 of this embodiment is disposed on the back side.

In other words, in the embodiment of FIGS. 21 and 22, the socket main body 1 may be merely inserted into the fitting hole 13 from the back of the printed board 12. At this time, the snap portlon 7 protruding from the distal end side is pushed and restricted by the rear side edge 13*b* of the fitting hole 13, once enters the terminal reception groove 4 and then stands up due to resilience. The socket main body 1 is thus clamped and fixed by the snap portions 7 and the contact portions 6 on the back which come into contact with the pattern face 16 on the back side. The socket main body 1 can be removed by rotating the snap portions 7 so as to face the guide/positioning grooves 14.

As described above, in the small lamp socket device for the panel/printed board according to the present invention, the socket main body to be inserted into the fitting hole of the panel/printed board includes the contact portions for the pattern face, formed by the leaf spring leaf material at the upper and lower (rear and front) positions of the side walls of the support arms and the snap portions for clamping and contacting the panel/printed board so formed as to protrude and oppose the contact portions, wherein the snap portions are provided with resilience so as to be capable of entering and coming out from at least the fitting hole. Therefore, the socket main body can be inserted from the front surface position of the panel/printed board. In other words, since it is only necessary to move the socket main body in the linear direction with respect to the socket main body, the socket main body can be easily fitted with one-touch (snap-in) operation, and can be freely removed from the back, too. Moreover, this means that the socket main body can be mounted to the printed board from the same side (the front side) as components (electronic components) other than the lamp.

The fitting hole and the shape have compatibility with PBB and PBC that have been already put on the market as the products, and packaging by an automatic machine becomes possible. Further, the terminal can be obtained easily by bending a metal spring leaf.

What is claimed is:

1. A small lamp socket device for a panel with at least a single fitting hole, comprising:

an insulating socket main body for receiving therein a small lamp, contact portions of a metal spring for a pattern face, said contact portions serving as terminals, and snap portions of a metal spring for clamping and contacting said panel, said snap portions serving as terminals, said contact portions and said snap portions being disposed at upper and lower positions of side walls of said insulating socket main body in such a fashion as to project and oppose one another in a spaced confronting relation, said snap portions having resilience to come into and out from said socket main body, said panel being clamped by said contact portions and said snap portions after passing through said fitting hole of said panel.

2. A small lamp socket device for a panel according to claim 1, wherein the terminals of said contact portions and said snap portions are connected together in a unitary structure.

3. A small lamp socket device for a panel according to claim 1, wherein the terminals of said contact portions and said snap portion are separated from each other.

4. A small lamp socket device for a panel according to claim 1, wherein said snap portion is formed by bending arcuate plates, said arcuate plates each having a plurality of engagement portions for an edge of said fitting hole of said panel.

5. A small lamp socket device for a panel with at least a single fitting hole, comprising:

an insulating socket main body for receiving therein a small lamp, contact portions of a metal spring for a pattern face, said contact portions serving as terminals, snap portions of a metal spring for clamping and contacting said panel, said snap portions serving as terminals, said contact portions and said snap portions being disposed at upper and lower positions of side walls of said insulating socket main body in such a fashion as to project and oppose one another in a spaced confronting relation, said snap portions having resilience to come into and out from said socket main body, said panel being clamped by said contact portions and said snap portions after passing through said fitting hole of said panel, and fall-prevention means formed at opposing walls orthogonally crossing the position of the terminals of said socket main body.

6. A small lamp socket device for a panel according to claim 5, wherein said fall-prevention means has projections formed at front and rear walls orthogonally crossing said terminals of the socket main body.

* * * * *